US010276085B2

(12) United States Patent
Wang et al.

(10) Patent No.: US 10,276,085 B2
(45) Date of Patent: Apr. 30, 2019

(54) PIXEL SIGNAL COMPENSATION FOR A DISPLAY PANEL

(71) Applicant: Apple Inc., Cupertino, CA (US)

(72) Inventors: Chaohao Wang, Cupertino, CA (US); Paolo Sacchetto, Cupertino, CA (US); Marc Albrecht, San Francisco, CA (US); Christopher P. Tann, San Jose, CA (US); Shih-Chyuan Fan Jiang, Taipei (TW); Howard H. Tang, San Diego, CA (US); James E. C. Brown, San Jose, CA (US); Zhibing Ge, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 25 days.

(21) Appl. No.: 14/973,517

(22) Filed: Dec. 17, 2015

(65) Prior Publication Data

US 2017/0018219 A1 Jan. 19, 2017

Related U.S. Application Data

(60) Provisional application No. 62/193,491, filed on Jul. 16, 2015.

(51) Int. Cl.
*G09G 3/20* (2006.01)

(52) U.S. Cl.
CPC ... *G09G 3/2092* (2013.01); *G09G 2320/0204* (2013.01); *G09G 2320/0223* (2013.01); *G09G 2320/0233* (2013.01); *G09G 2320/0285* (2013.01); *G09G 2320/0693* (2013.01)

(58) Field of Classification Search
CPC ..... G09G 3/2092; G09G 2320/0204; G09G 2320/0693; G09G 2320/0233; G09G 2320/0285; G09G 2320/0223
See application file for complete search history.

(56) References Cited

U.S. PATENT DOCUMENTS

| | | | | |
|---|---|---|---|---|
| 5,841,410 | A * | 11/1998 | Oda | G09G 3/3648 345/58 |
| 6,472,688 | B2 | 10/2002 | Miyata | |
| 7,551,164 | B2 | 6/2009 | Deane | |
| 2007/0132895 | A1* | 6/2007 | Shen | G09G 3/2007 349/1 |
| 2008/0117231 | A1* | 5/2008 | Kimpe | G09G 3/20 345/629 |
| 2008/0165108 | A1* | 7/2008 | Shen | G09G 3/3614 345/94 |

(Continued)

*Primary Examiner* — Charles V Hicks
(74) *Attorney, Agent, or Firm* — Kilpatrick Townsend & Stockton

(57) ABSTRACT

This application relates to systems, methods, and apparatus for compensating voltage for pixels of a display panel based on the location of the pixels within the display panel. An amount of voltage compensation is assigned to each pixel or a group of pixels within the display panel in accordance with a calibration of the display panel. During operation of the display panel, pixel data is generated for a location of the display panel, and the pixel data is modified according to the amount of voltage compensation corresponding to the location. By modifying the pixel data in this way, spatial variations in voltage across the display panel can be mitigated in order to reduce the occurrence of certain display artifacts at the display panel.

19 Claims, 7 Drawing Sheets

(56) References Cited

U.S. PATENT DOCUMENTS

| | | | | |
|---|---|---|---|---|
| 2009/0141049 | A1 | 6/2009 | Ha et al. | |
| 2015/0194119 | A1* | 7/2015 | Ahn | G09G 3/3696 345/213 |

* cited by examiner

PIXEL SIGNAL COMPENSATION FOR A DISPLAY PANEL

CROSS-REFERENCE TO RELATED APPLICATION

The present application claims the benefit of U.S. Provisional Application No. 62/193,491, entitled "PIXEL SIGNAL COMPENSATION FOR A DISPLAY PANEL," filed Jul. 16, 2015, the content of which is incorporated herein by reference in its entirety for all purposes.

FIELD

The described embodiments relate generally to charging schemes for display panels. More particularly, the present embodiments relate to selectively compensating a voltage for a pixel in a pixel array based on a location of the pixel within the pixel array.

BACKGROUND

The prevalence of flat panel displays in portable electronics has led to an increasing demand for higher resolution displays that are both energy efficient and able to quickly present large amounts of data. Additionally, as display devices become larger, certain display artifacts such as flicker can be more apparent because of how far some pixels of the display device are from their charge source. Distances between pixels and charge sources can cause the charge times of some pixels to be slower or faster than other pixels thereby causing visible boundaries between certain columns and rows of pixels. Although some pixel inversion schemes are available to handle the issue of boundary visibility, such schemes can be inefficient and cause other display artifacts such as image sticking to occur.

SUMMARY

This paper describes various embodiments that relate to reducing display artifacts according to one or more signal compensation schemes. In some embodiments, a method is set forth for compensating a pixel signal based on a location of a pixel within a pixel array of a display panel. The method can include a step of selecting a compensation value for the pixel signal according to a location of the pixel within the pixel array. The compensation value can be selected from a plurality of compensation values that correspond to different locations within the pixel array. The method can further include a step of compensating the pixel signal according to the compensation value. Additionally, the method can include identifying a voltage compensation value for a voltage buffer connected to the pixel within the pixel array.

In other embodiments, a display controller is set forth. The display controller can include a memory configured to store correspondence data between pixel compensation values and different locations on a display panel. The display controller can further include a pixel input configured to sequentially receive a first pixel signal and a second pixel signal for a first pixel and a second pixel, respectively, of the display panel. The display controller can also include a logic component configured to (i) access the correspondence data and (ii) compensate the first pixel signal and the second pixel signal differently based on a location of each of the first pixel and the second pixel on the display panel. The first pixel signal and the second pixel signal can correspond to reference voltage signals for a voltage buffer of the display panel.

In yet other embodiments, a computing device is set forth. The computing device can include a display panel comprising a pixel array, and a graphics processor configured to generate a pixel signal for each pixel of the pixel array. The computing device can further include a display driver configured to: determine a location of each pixel in the pixel array and compensate a voltage of the pixel signal according to the location of the pixel in the pixel array to reduce flicker occurring at the display panel. Additionally, the computing device can include a memory configured to store at least one lookup table that includes a correspondence between locations of pixels in the pixel array and a voltage compensation value for each location.

This Summary is provided merely for purposes of summarizing some example embodiments so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1A:
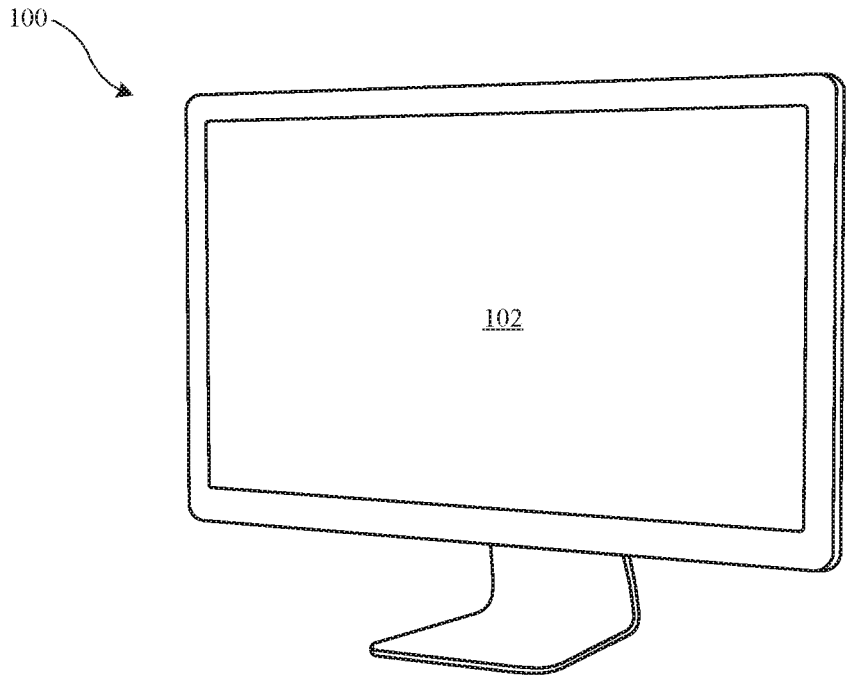
FIGS. 1A and 1B illustrate perspective views of a simplified circuit of a display panel and a pixel array.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Display panels can have a plurality of pixels connected in a pixel array that can be connected to a column driver, a scan driver, and/or a voltage buffer. In large flat panel displays, the pixel array can be spread over a wide area making it difficult to charge all pixels uniformly. As a result, certain portions of the display can exhibit certain display artifacts more than others because of differences in charge. Some existing techniques, such as z-inversion, can be used to mitigate certain display artifacts occurring at a display panel. For example, when using a z-inversion scheme, a pattern of pixel polarity is established across the scan lines of the display panel and a different pattern of pixel polarity is established across the column lines of the display panel. In this way, inverting pixel polarities differently between scan lines and column lines can mitigate some perceivable artifacts such as flicker. Unfortunately, such inversion schemes can still result in spatial variations in charge across the area of the display panel. These spatial variations can be due to voltage kickback caused by periodically inverting the polarity of voltage across the pixel array. Furthermore, the distance between some pixels and the column driver, scan driver, and/or voltage buffer can also cause spatial variations in charge when charge is depleted before reaching certain pixels. However, in order to mitigate certain display artifacts and provide a power efficient charging scheme, one or more voltage compensation techniques discussed herein can be used.

In some embodiments discussed herein, a voltage compensation operation can be used to mitigate spatial variations in voltage across the area of a display panel, such as an organic light emitting diode (OLED) display, light emitting diode (LED) display panel, or liquid crystal display (LCD). The display panel can be segmented such that multiple areas of the display panel receive different buffer voltages or VCOM signals. For example, if a display panel has dimensions X by Y, where X and Y are each a number of pixels, then each segment of the panel can be R by S, where R and S are each a number of pixels and at least one of R and S is less than X or Y. Each segment can be associated with a VCOM signal that will be received by the pixels within each segment. In this way, at least two segments of the display panel can receive different VCOM signals. In some embodiments, each segment is of equal or different area. For example, a display panel having dimensions X by Y can have M by N segments, wherein the product of X and Y is the total number of pixels and the product of M and N is the total number of segments. In this way, M and/or N groups of columns lines and/or scan rows can each be connected to a voltage buffer. As scanning is performed up or down the rows of the display panel, each voltage buffer can provide a different VCOM signal depending on the segment or segments that are being illuminated. As a result, individual or groups of pixels can receive different VCOM signals in order to compensate for spatial variations in voltage across the area of the display panel.

The voltage or current values that define each VCOM signal for each segment can be set during calibration of the display panel. The calibration process can use a high speed camera to measure the luminance of various segments of the display panel over time and generate a wave form corresponding to the change in luminance for each segment over time. The wave form can thereafter be used to determine an optimal voltage for the VCOM signal that reduces flicker at each segment. The process of measuring the waveform for each segment and determining the optimal voltage for the VCOM signal can be performed over multiple iterations in order to further optimize the voltage for the VCOM signal for each segment. Once the voltage or current for each VCOM signal for each segment is derived and optimized, the display panel can be configured to provide the VCOM signals to their corresponding segments. For example, each segment can be connected to an operational amplifier that is configured to receive one or more reference voltages corresponding to the optimized VCOM signals for one or more segments. In this way, when a row or column of a segment of the display panel is being provided pixel data, the reference voltage for the segment can be provided to the operational amplifier for the segment and thereafter output as the VCOM signal. Because the reference voltage or VCOM signal was previously optimized during calibration, the pixels of the segment will be charged in a manner that reduces display artifacts such as flicker.

In some embodiments, VCOM optimization can be performed digitally using a display controller that stores or accesses a correspondence between pixel locations within a pixel array and compensations values for a VCOM signal for each pixel of the pixel array. During operation of the display panel, the display controller can receive pixel data corresponding to a pixel at a pixel location within the pixel array. The display controller can determine the compensation value to be applied to pixel based on the pixel location. Using the correspondence between the pixel location and a compensation value, the pixel data sent to the pixel can be modified according to the compensation value. In this way, the pixel will illuminate according to the modified pixel data thereby reducing display artifacts that can be exhibited by the pixel array during operation. In some embodiments, a correspondence between gray level and each compensation value is stored or accessed by the display controller during operation of a display panel to which the display controller is connected. In this way, an original gray level value for an amount of pixel data can be adjusted based on a compensation value. For example, the display controller can first determine a compensation value according to a location of a pixel that is to be illuminated based on pixel data. Thereafter, the display controller can determine a value for gray level compensation to be applied to the pixel data in order to adjust the original gray level value of the pixel data before the pixel data is received by a pixel.

In some embodiments, a pixel polarity and/or a type of inversion scheme can be metrics for determining how much to compensate VCOM for a particular pixel at a particular location. For example, the display controller can store or access a correspondence between pixel polarity and a compensation value such that VCOM for each pixel or segment can be adjusted according to both the location of the pixel in the pixel array and the polarity of the pixel. Furthermore, the display controller can store or access a correspondence between an inversion scheme (e.g., column inversion, z-inversion, dot inversion) being employed by the display panel and a compensation value. In this way, VCOM for each pixel or segment can be adjusted according to the location of the pixel in the pixel array, the inversion scheme being employed by the display panel, the polarity of the pixel, and/or any combination thereof. The correspondence between the pixel locations, compensation values, pixel polarities, and/or inversion schemes can be provided in one or more lookup tables stored by or accessible to a display controller connected to a display panel. Additionally, the compensation values can correspond to shift values representing an amount that the VCOM voltage should be shifted for a given pixel or group of pixels. For example, each shift value can be a voltage value, percentage value, or any other suitable value for indicating an amount of compensation for a signal.

These and other embodiments are discussed below with reference to FIGS. 1A-7; however, those skilled in the art will readily appreciate that the detailed description given herein with respect to these figures is for explanatory purposes only and should not be construed as limiting.

Figure 1B:
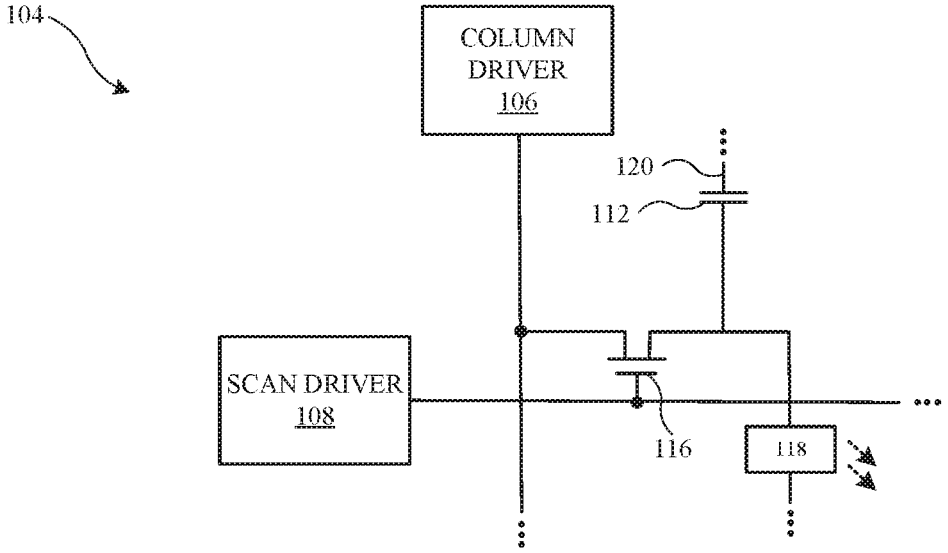

FIGS. 1A and 1B illustrate perspective views 100 of a simplified circuit of a display panel 102 and a pixel or LED array 104. The display panel 102 can be a display panel using a pixel array 104 to output light at the display panel 102. It should be noted that the term display panel as used herein can refer to the display of a laptop computing device, desktop computing device, media player, cellular phone, television, or any other electronic device incorporating an (organic light emitting diode) OLED display, (light emitting diode) LED display panel, or liquid crystal display (LCD). FIG. 1B illustrates the pixel array 104 for use in the display panel 102, or any other suitable display device. However, it should be noted that FIG. 1B is merely provided as an example of a display circuit for a display panel and should not be viewed as limiting the scope of this disclosure. Therefore, any of the embodiments discussed herein can be applied to any suitable display circuit arrangement in order to reduce display artifacts at a display panel (e.g., an LED, LCD, or OLED display) using VCOM optimization.

The pixel array 104 of FIG. 1B can include any suitable number of pixels or LEDs 118, but for simplicity, a single pixel 118 is illustrated. Each pixel 118 can receive a supply signal from a scan driver 108 and column driver 106. During operation of the pixel array 104, the scan driver 108 can provide a signal to a gate of a transistor 116, which allows for a signal provided from the column driver 106 to be received by the pixel 118. The transistor 116 can be coupled to a capacitor 112, which can be charged by a voltage buffer line 120 that carries a VCOM signal and provides a charge for the pixel 118. The pixel 118 will receive the charge from the capacitor 112 when the transistor 116 closes as a result of receiving the signal from the scan driver 108. The signal from the column driver 106 and the charge from the capacitor 112 will pass through the pixel 118 thereby allowing the pixel 118 to illuminate. The pixel 118 can illuminate even after the signal from the scan driver 108 and/or the column driver 106 have terminated because of the charge stored by the capacitor 112. Unfortunately, in display panels having numerous pixels 118, the amount of charge available to each pixel 118 can be depleted more quickly based on a distance the pixel 118 is from the column driver 106 and/or the scan driver 108. In order to compensate for the charge or voltage depletion of the capacitor(s) 112, the VCOM signal can be optimized according to a location of the pixel 118 within the display panel 102. The optimization can be further based on polarity of the pixel that is to be illuminated and/or an inversion scheme being employed by the display panel 102.

Figure 2A:
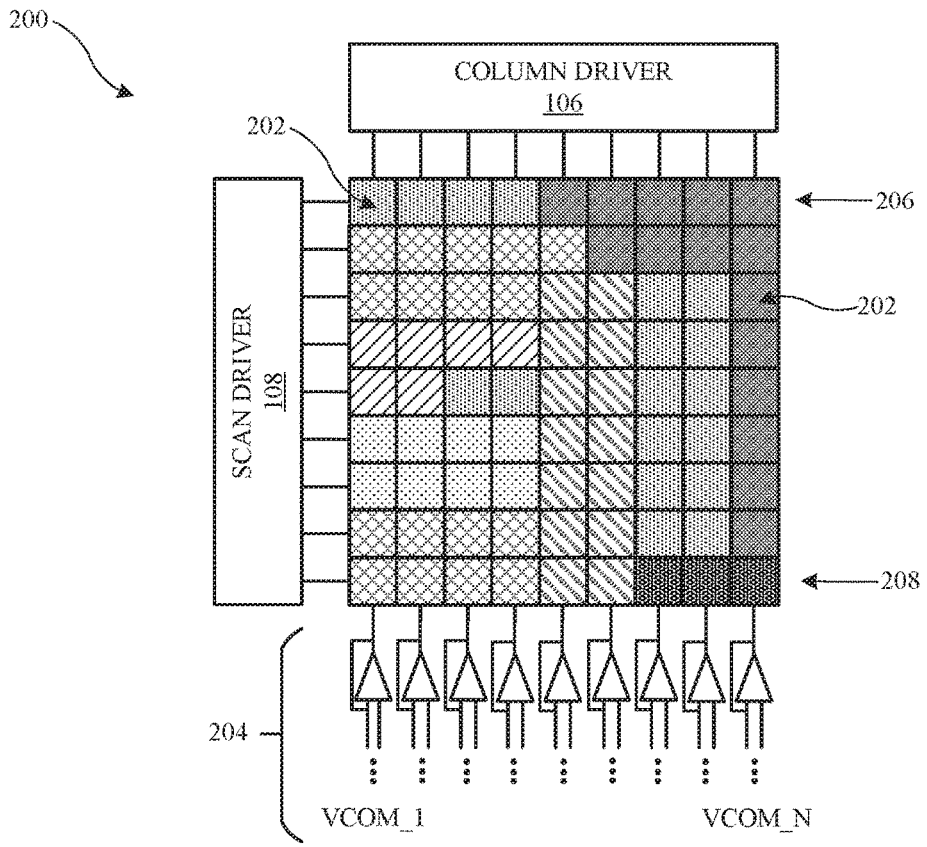
FIG. 2A illustrates a display panel with multiple segments that can represent individual pixels or groups of pixels that can be provided a VCOM signal that is optimized for each particular segment.

FIG. 2A illustrates a display panel 200 with multiple segments 202 that can represent individual pixels or groups of pixels that can each be provided a VCOM signal that is optimized for each particular segment 202. Each segment 202 can be connected to the column driver 106 and the scan driver 108 for receiving pixel data and charge when one or more pixels of each segment 202 are to be illuminated according to the pixel data. Each segment 202 can also be connected to one or more voltage buffers 204 that can each provide one or more optimized VCOM signals to each of the segments 202. In this way, the VCOM_1 and VCOM_N signals can dynamically change in different manners (as indicated by the different patterns in each segment 202) depending on the segments 202 that each voltage buffer 204 is connected to. For example, during operation of the display panel 200, the scan driver 108 can provide signals up or down the display panel 200 in a sequential manner when executing a frame of pixel data. When the scan driver 108 is providing a signal to the first row 206 or last row 208, a voltage component or current component of the VCOM signals VCOM_1 through VCOM_N can be the same or different. The scan driver 108 can sequentially provide signals to the other rows of the display panel 200, and for each row the VCOM signals VCOM_1 through VCOM_N can increase, decrease, or stay the same. The values of VCOM_1 through VCOM_N for each segment can vary based on a previous calibration of the display panel 200. During calibration, optimum values of a VCOM signal for each segment 202 can be generated. Furthermore, the values of VCOM_1 through VCOM_N for each segment can vary based on the location of the segment 202 within the display panel 200, the polarity of the pixel data that is to be received by the segment 202, the polarity of the frame executing at the display panel 200, and/or the inversion scheme being employed by the display panel 200.

Figure 2B:
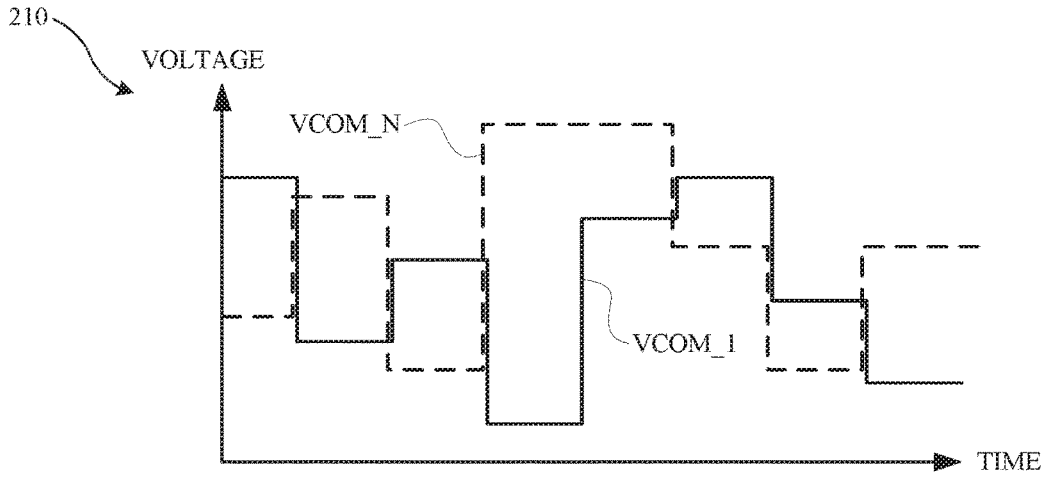
FIG. 2B illustrates a plot of an example of differences in VCOM_1 and VCOM_N over time.

FIG. 2B illustrates a plot 210 of an example of differences in VCOM_1 and VCOM_N over time. Specifically, during the execution of a frame of pixel data, each VCOM signal corresponding to VCOM_1 through VCOM_N can vary according to a reference voltage that has been assigned to each segment 202 during calibration of the display panel 200. The reference voltage received by each voltage buffer 204 when pixel data is received at each segment 202 will determine the VCOM signal that will be received by each segment 202. The variations in reference voltage can mitigate spatial variations in voltage across the display panel 200, thereby eliminating many display artifacts such as flicker, especially when operating at and transitioning to lower refresh rates.

Figure 3:
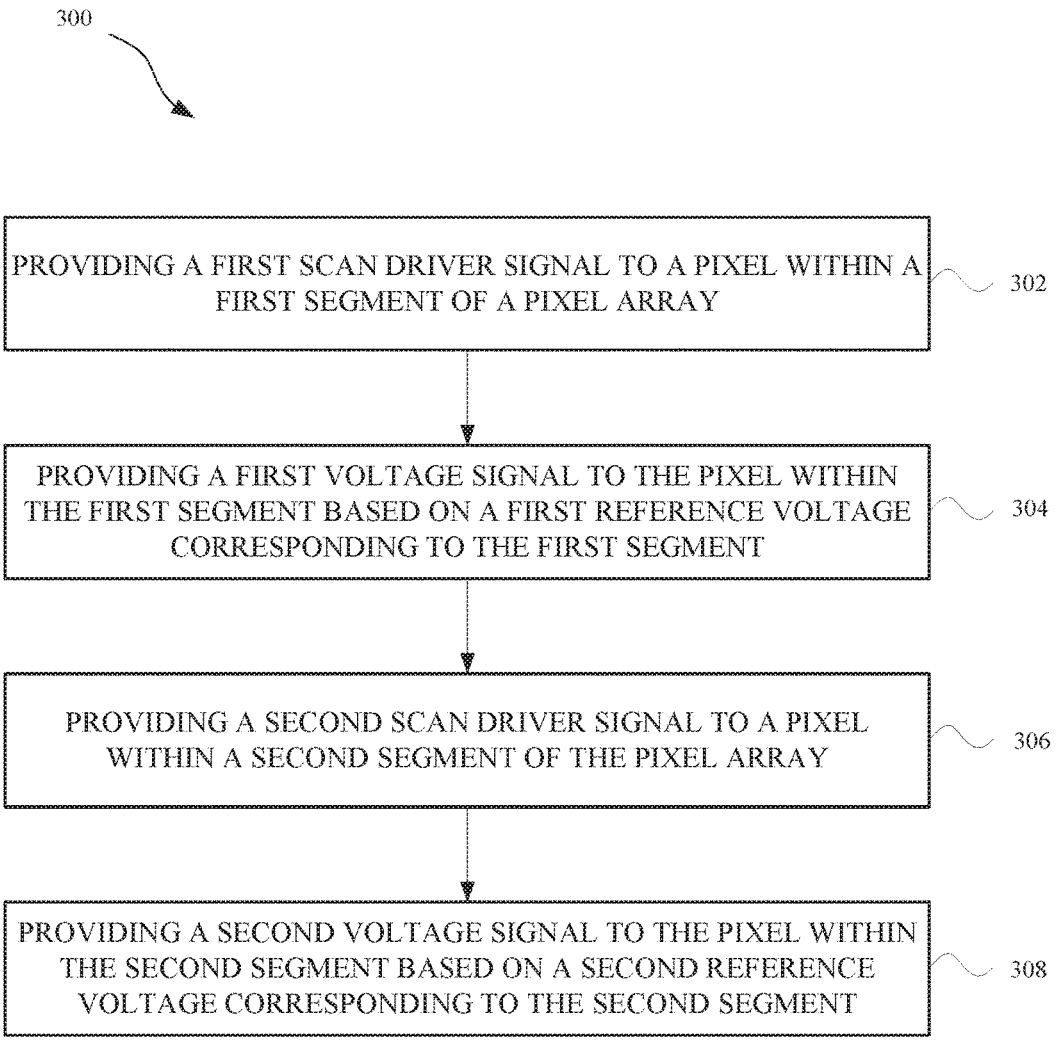
FIG. 3 illustrates a method for using optimized VCOM signals in order to reduce display artifacts occurring at a display panel.

FIG. 3 illustrates a method 300 for using optimized VCOM signals in order to reduce display artifacts occurring at a display panel. The method 300 can be performed by a device, circuit, component, processor, computer, controller, or any other apparatus suitable for mitigating display artifacts occurring at a display panel. The method 300 can include a step 302 of providing a first scan driver signal to a pixel within a first segment of a pixel array. The first segment can include a single pixel or LED, or multiple pixels or LEDs. Additionally, the pixel array can be any size pixel array suitable for displaying images on a mobile computing device or mounted display panel. The pixel array can include any suitable number of segments between one and the total number of pixels for in the pixel array. The method 300 can further include a step 304 of providing a first voltage signal to the pixel within the first segment based on a first reference voltage corresponding to the first segment. The first voltage signal can correspond to a VCOM signal for charging a charge storage component, such as a capacitor or wire, connected to the pixel in the first segment. At step 306, the method 300 includes providing a second scan drive signal to a pixel within a second segment of the pixel array. A second voltage signal is provided at step 308 to the pixel within the second segment based on a second reference voltage corresponding to the second segment. The second voltage signal can be of the same or different amplitude than the first voltage signal. Additionally, each of the first voltage signal and second voltage signal can be optimized in order to reduce spatial variations in voltage across the display panel while also improving power efficiency of the display panel.

Figure 4:
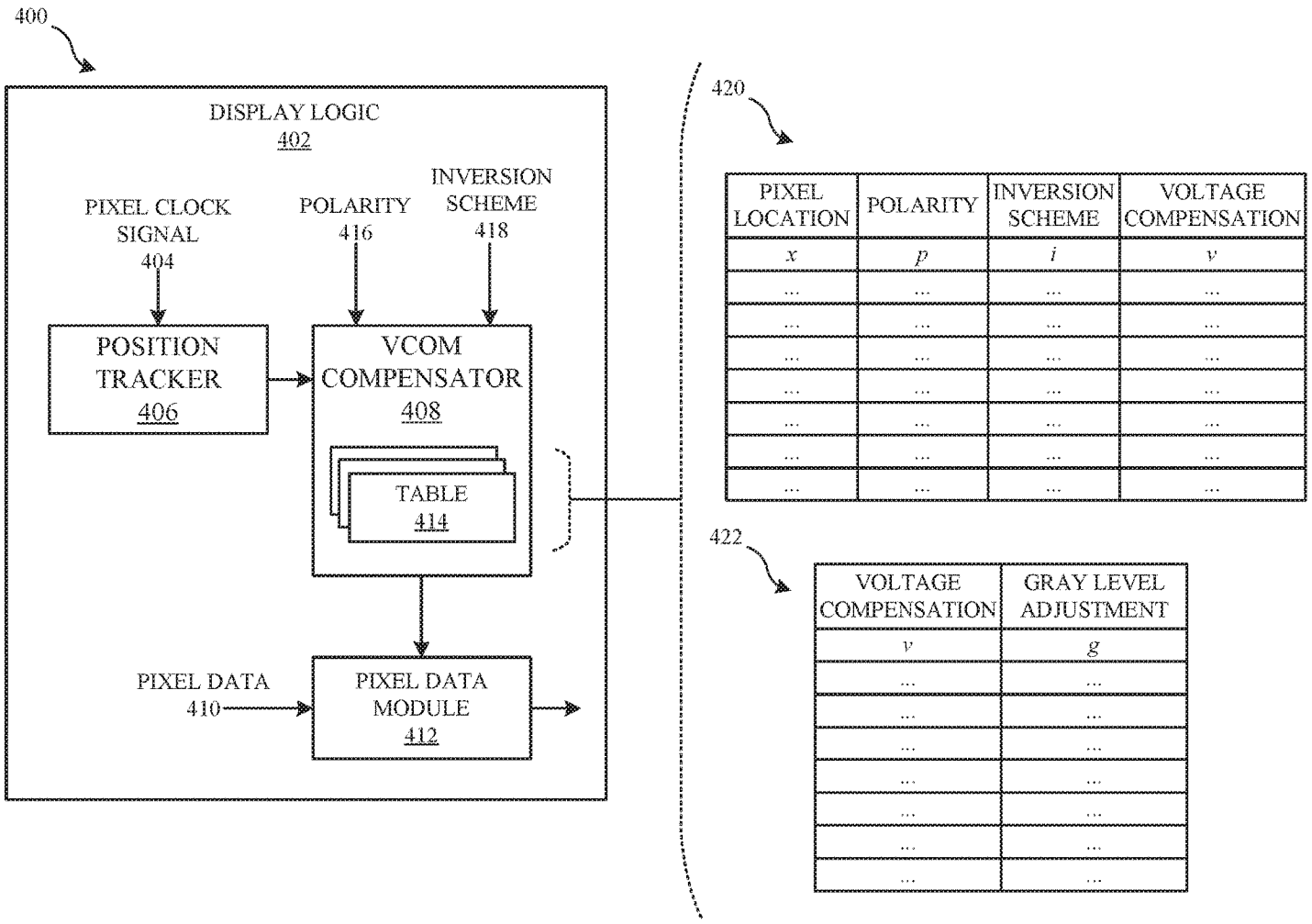
FIG. 4 illustrates a system diagram of display logic that can be used to perform voltage compensation on pixel data.

FIG. 4 illustrates a system diagram 400 of display logic 402 that can be used to perform voltage compensation on pixel data 410. The display logic 402 can be implemented as an analog circuit, or digital circuit having a processor and a memory. The display logic 402 can include a position tracker 406 for tracking the position of each pixel in a display panel receiving pixel data 410. The position tracker 406 can receive a signal for a pixel clock 404 and determine the position of the next pixel to receive the pixel data 410 based on a value and/or timing of the pixel clock 404. As the location of each pixel of the display panel is determined, location data can be provided to a VCOM compensator 408. The VCOM compensator 408 can determine an amount by which to compensate VCOM or a buffer voltage for a respective pixel or group of pixels based on the location data provided from the position tracker 406. Optionally, the VCOM compensator can also determine an amount by which to compensate VCOM based on polarity 416 and inversion scheme 418. The polarity 416 can refer to the voltage polarity of a pixel, group of pixels, or a frame of pixel data provided to the display panel. Because spatial variations in voltage can arise from differences in voltage between each pixel, and the voltage differences can be based on whether the polarity of a pixel is positive or negative, adjustments to VCOM can vary based on polarity. Furthermore, and optionally, the type of inversion scheme 418 used when charging pixels of a display panel can be a factor for the VCOM compensator 408 to determine an amount of voltage compensation to apply to a pixel or group of pixels.

The VCOM compensator 408 can store or access one or more tables 414 in order to determine the amount of compensation to apply to the display panel when pixel data 410 is being displayed at the display panel. Each table 414 can include correspondence between pixel location, voltage compensation, polarity, inversion scheme, or any combination thereof. For example, a table 414 can include values indicative of a pixel location, and/or a location of a group of pixels within a display panel, and values indicative of an amount of voltage compensation to apply to the pixel or group of pixels. In this way, the VCOM compensator 408 can receive a pixel location from the position tracker 406 and determine a correspondence between the pixel location and an amount of voltage compensation to apply to the pixel associated with the pixel location. Furthermore, in embodiments where the VCOM compensator 408 is configured to determine the amount of voltage compensation based on polarity and pixel location, the VCOM compensator 408 can receive both pixel location and pixel polarity from any suitable source. Thereafter, the VCOM compensator 408 can access one or more tables 414 to determine a correspondence between the pixel location, pixel polarity, and the voltage compensation value. Furthermore, in embodiments where the VCOM compensator 408 is configured to determine the voltage compensation value based on pixel location and the inversion scheme, the VCOM compensator 408 can receive both the pixel location and the inversion scheme from any suitable source. Thereafter, the VCOM compensator 408 can access one or more tables 414 to determine a correspondence between the pixel location, inversion scheme, and the voltage compensation value. In some embodiments, the VCOM compensator 408 can access a table 414 that includes correspondence between an amount of voltage compensation and an amount of gray level that should be adjusted for a particular pixel or group of pixels. For example, when an amount of voltage compensation is determined for a pixel location, the VCOM compensator 408 can determine amount of gray level adjustment based on the voltage compensation value. Thereafter, the VCOM compensator 408 can output a signal indicating a voltage compensation value or gray level adjustment after a correspondence is determined according to any of the embodiments discussed herein.

Once a correspondence is determined between one or more inputs to the VCOM compensator 408 and an amount of voltage compensation, the pixel data 410 can be updated according to the amount of voltage compensation or gray level adjustment. The pixel data 410 can be updated at a pixel data module 412 where the pixel data 410 can be modified according to the amount of voltage compensation or gray level adjustment that is output from the VCOM compensator 408. The pixel data module 412 can be any suitable component, circuit, or software module suitable for modifying pixel data. For example, in some embodiments, the pixel data module 412 is a white point correction module, which can define white point that quantifies an amount of white color to be included when a pixel is outputting light. In this way, the amount of voltage compensation or gray level adjustment can be included with any white point data that is used to adjust the pixel data 410. In other embodiments, the pixel data module 412 is a panel response correction module that can modify the pixel data 410 according to rate of change and/or a magnitude of change between the incoming pixel data 410. In this way, the amount of voltage compensation or gray level adjustment can be combined with any adjustments that the panel response correction module is making in order to reduce display artifacts at a display panel.

A lookup table 420 is provided in FIG. 4 as an example of one or more of the tables 414. The lookup table can optionally include one or more rows or columns corresponding to values for pixel location ("x"), polarity ("p"), inversion scheme ("i"), and/or voltage compensation ("v"). In this way, when the VCOM compensator 408 receives the pixel location from the position tracker 406, the pixel location ("x") can be found in the lookup table 420, and a corresponding voltage compensation ("v") can be found in the lookup table. In embodiments where a gray level adjustment value ("g") is used to modify the pixel data 410, a supplemental lookup table 422 can optionally be used to determine an amount of gray level adjustment that should be employed for each voltage compensation value in lookup table 420. For example, a pixel location ("x") can be used to determine a voltage compensation value ("v"), and using the voltage compensation value ("v") a corresponding gray level adjustment value ("g") can be identified in the supplemental lookup table 422. Thereafter, the gray level adjustment value ("g") can be used to modify the pixel data 410 to mitigate the prevalence of display artifacts at a display panel.

Figure 5:
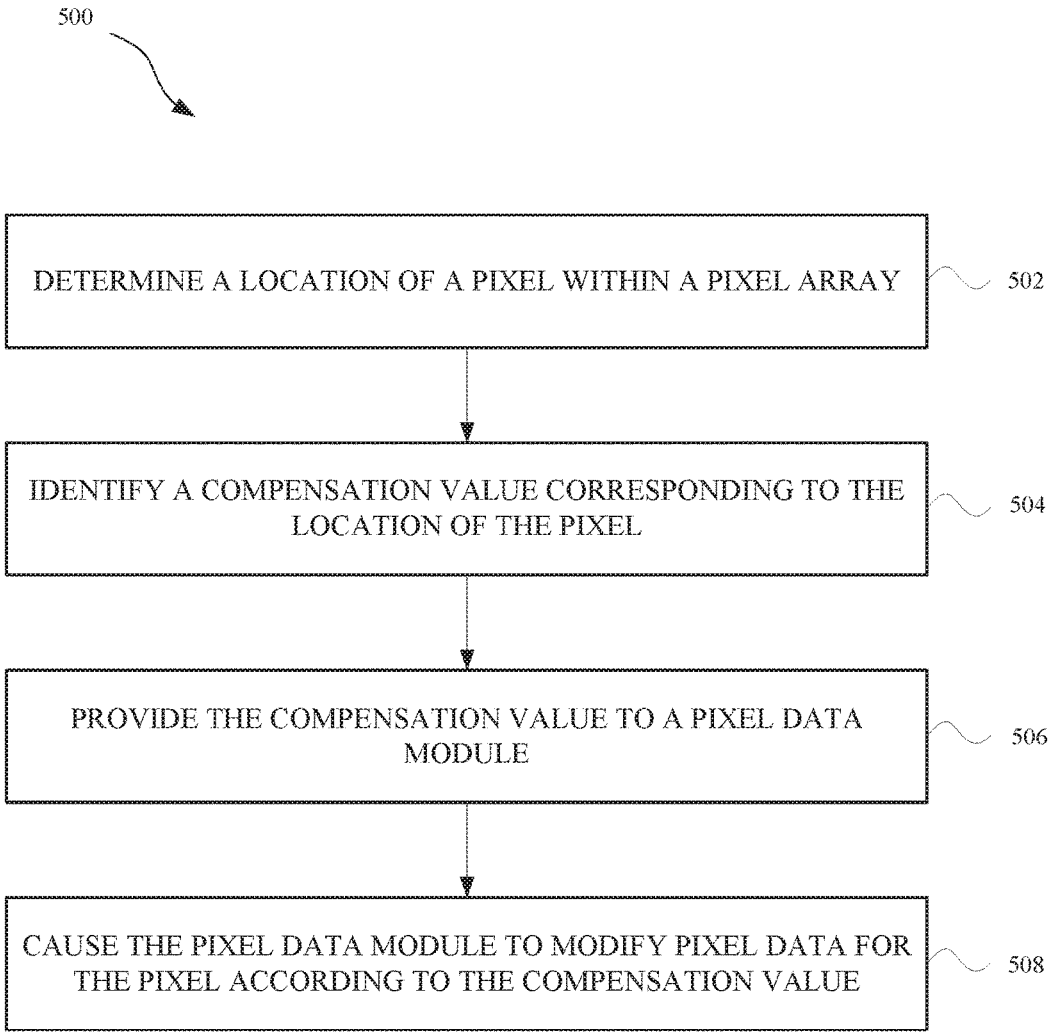
FIG. 5 illustrates a method for performing voltage compensation for a voltage signal of a display panel according to the location of a pixel of the display panel.

FIG. 5 illustrates a method 500 for performing voltage compensation for a voltage signal of a display panel according to the location of a pixel of the display panel. The method 500 can be performed by any suitable component, circuit, apparatus, processor, or computing device suitable for performing voltage compensation on a signal. The method 500 can include a step 502 of determining a location of a pixel within a pixel array. The location of the pixel can be determined by referencing a position tracker that uses a pixel clock to track the location of a pixel that is currently receiving or going to receive pixel data, as discussed herein. The method 500 can further include a step 504 of identifying an amount of voltage compensation corresponding to the location of the pixel. The amount of voltage compensation can range from zero volts to multiple volts. Furthermore, the amount of voltage compensation can be quantified as a percentage, unitless value, fraction, charge value, voltage value, or any other suitable metric for indicating an amount of compensation. At step 506 of method 500, the amount of voltage compensation identified at step 504 is provided to a pixel data module in order for the pixel data to be modified according to the amount of voltage compensation. At step 508 of method 500, the pixel data module modifies the pixel data for the pixel receiving the pixel data. The method 500 can be repeated for each pixel or group of pixel in a pixel array of the display panel. Additionally, the method 500 can be modified to identify an amount of gray level adjustment for the pixel data based on the identified amount of voltage compensation.

Figure 6:
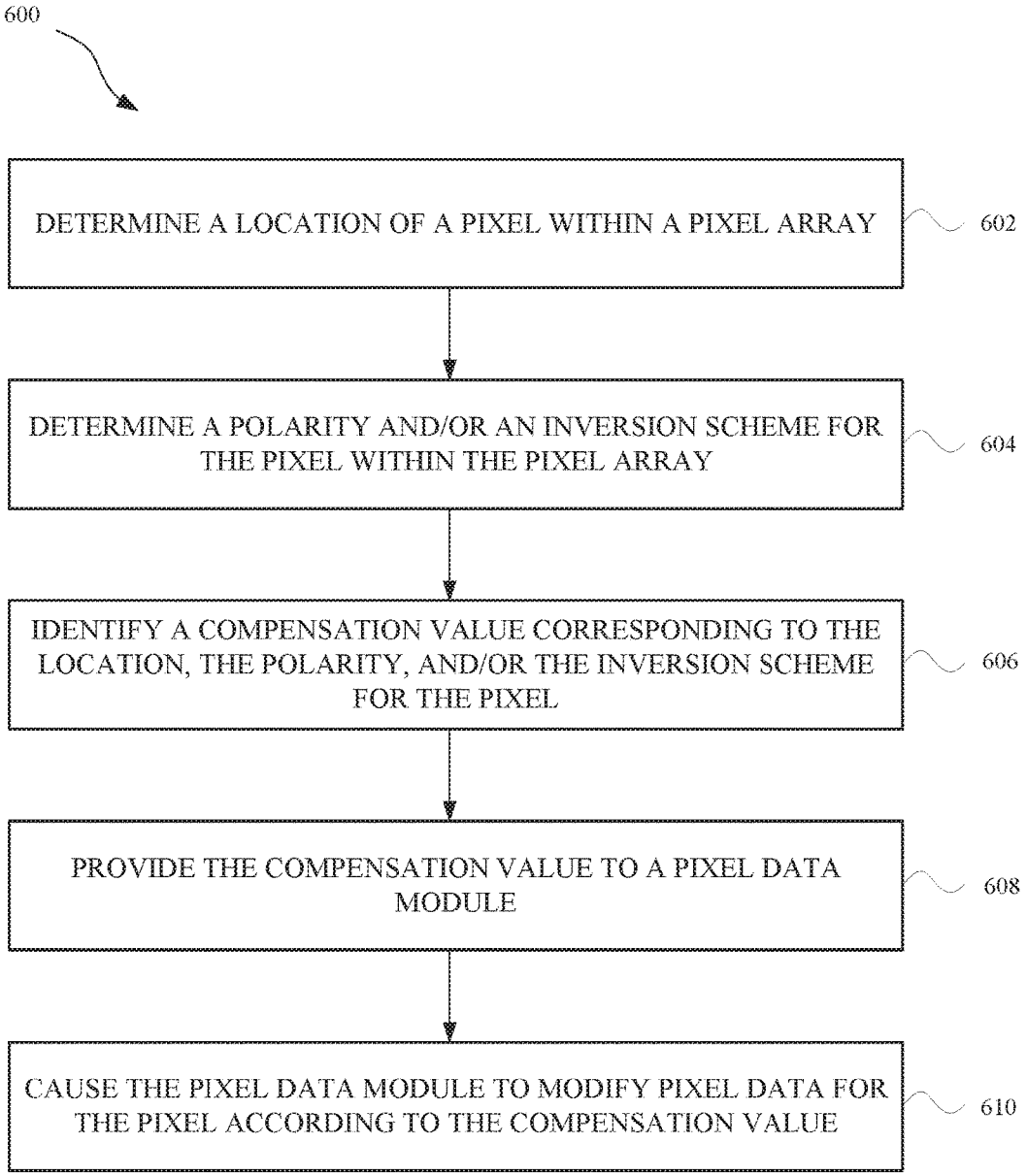
FIG. 6 illustrates a method for performing voltage compensation for a voltage signal of a display panel according to the location, polarity, and/or inversion scheme for a pixel of the display panel.

FIG. 6 illustrates a method 600 for performing voltage compensation for a voltage signal of a display panel according to the location, polarity, and/or inversion scheme for a pixel of the display panel. The method 600 can be performed by any suitable component, circuit, apparatus, processor, or computing device suitable for performing voltage compensation on a signal. The method 600 can include a step 602 of determining a location of the pixel within the pixel array, as discussed herein. At step 604, a polarity and/or pixel inversion scheme is determined for the pixel array. The polarity can refer to whether the voltage of a pixel is positive or negative. The inversion scheme can refer to the inversion scheme that is being employed by the display panel when transmitting pixel data through the various rows and/or columns of the display panel. The inversion scheme can include a z-inversion, dot inversion, column inversion, or any other suitable inversion scheme for a display panel. The method 600 can further include a step 606 of identifying an amount of voltage compensation corresponding to the location, the polarity, the inversion scheme, or any combination thereof. The correspondence between the amount of voltage compensation and the location, the polarity, and/or the inversion scheme can be identified using one or more lookup tables as further discussed herein. At step 608 of method 600, the amount of voltage compensation identified at step 606 is provided to a pixel data module, as discussed herein. As result, and at step 610 of the method 600, the pixel data module modifies the pixel data for the pixel according to the amount of voltage compensation. The method 600 can be repeated for each pixel or group of pixel in a pixel array of the display panel. Additionally, the method 600 can be modified to identify an amount of gray level adjustment for the pixel data based on the identified amount of voltage compensation.

Figure 7:
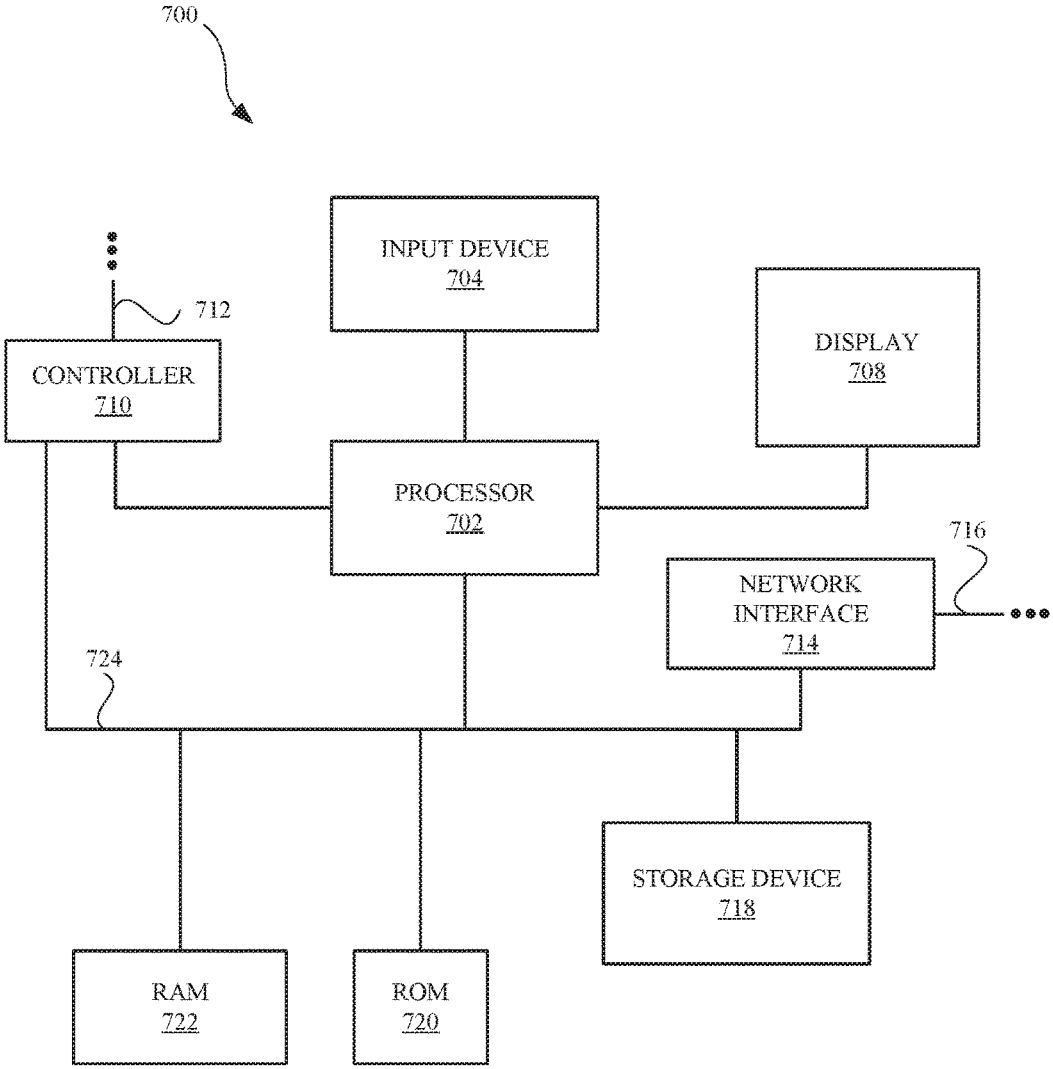
FIG. 7 is a block diagram of a computing device that can represent the components of the computing device, display controller, and/or display panel discussed herein.

FIG. 7 is a block diagram of a computing device 700 that can represent the components of the computing device, display driver, and/or display panel operating according any of the embodiments discussed herein. It will be appreciated that the components, devices or elements illustrated in and described with respect to FIG. 7 may not be mandatory and thus some may be omitted in certain embodiments. The computing device 700 can include a processor 702 that represents a microprocessor, a coprocessor, circuitry and/or a controller 710 for controlling the overall operation of computing device 700. Although illustrated as a single processor, it can be appreciated that the processor 702 can include a plurality of processors. The plurality of processors can be in operative communication with each other and can be collectively configured to perform one or more functionalities of the computing device 700 as described herein. In some embodiments, the processor 702 can be configured to execute instructions that can be stored at the computing device 700 and/or that can be otherwise accessible to the processor 702. As such, whether configured by hardware or by a combination of hardware and software, the processor 702 can be capable of performing operations and actions in accordance with embodiments described herein.

The computing device 700 can also include user input device 704 that allows a user of the computing device 700 to interact with the computing device 700. For example, user input device 704 can take a variety of forms, such as a button, keypad, dial, touch screen, audio input interface, visual/image capture input interface, input in the form of sensor data, etc. Still further, the computing device 700 can include a display 708 (screen display) that can be controlled by processor 702 to display information to a user. Controller 710 can be used to interface with and control different equipment through equipment control bus 712. The computing device 700 can also include a network/bus interface 714 that couples to data link 716. Data link 716 can allow the computing device 700 to couple to a host computer or to accessory devices. The data link 716 can be provided over a wired connection or a wireless connection. In the case of a wireless connection, network/bus interface 714 can include a wireless transceiver.

The computing device 700 can also include a storage device 718, which can have a single disk or a plurality of disks (e.g., hard drives) and a storage management module that manages one or more partitions (also referred to herein as "logical volumes") within the storage device 718. In some embodiments, the storage device 718 can include flash memory, semiconductor (solid state) memory or the like. Still further, the computing device 700 can include Read-Only Memory (ROM) 720 and Random Access Memory (RAM) 722. The ROM 720 can store programs, code, instructions, utilities or processes to be executed in a non-volatile manner. The RAM 722 can provide volatile data storage, and store instructions related to components of the storage management module that are configured to carry out the various techniques described herein. The computing device 700 can further include data bus 724. Data bus 724 can facilitate data and signal transfer between at least processor 702, controller 710, network/bus interface 714, storage device 718, ROM 720, and RAM 722.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method for compensating a pixel signal based on a location of a pixel within a pixel array of a display panel, the method comprising:

by a logic component of the display panel:

selecting a voltage compensation value for the pixel signal according to a location of the pixel within the pixel array, wherein the voltage compensation value is selected from a plurality of voltage compensation values that correspond to different locations within the pixel array, wherein the voltage compensation value of the plurality of voltage compensation values is selected based on an inversion scheme having a correspondence provided in one or more lookup tables; and compensating the pixel signal according to the voltage compensation value, wherein selecting the voltage compensation value comprises:

identifying the voltage compensation value for a voltage buffer connected to the pixel within the pixel array, wherein the voltage compensation value is selected from a plurality of voltage, compensation values and compensates for a distance between the location of the pixel and a voltage source for the pixel, and wherein compensating the pixel signal comprises adjusting a VCOM voltage for the pixel based on the voltage compensation value.

2. The method of claim 1, wherein each voltage compensation value of the plurality of voltage compensation values correspond to a segment of the pixel array that includes multiple pixels.

3. The method of claim 1, wherein the voltage compensation value of the plurality of voltage compensation values is selected based on a pixel polarity value.

4. The method of claim 1, wherein the pixel array includes one or more organic light emitting diodes.

5. A display controller, comprising:

a memory configured to store correspondence data between pixel compensation values and different locations on a display panel;

a pixel input configured to sequentially receive a first pixel signal and a second pixel signal for a first pixel and a second pixel, respectively, of the display panel; and a logic component configured to (i) access the correspondence data and (ii) compensate the first pixel signal and the second pixel signal differently based on a location of each of the first pixel and the second pixel on the display panel, a distance between the location of each of the first pixel and the second pixel and a voltage source and based on an inversion scheme having correspondences provided in one or more lookup tables, wherein the first pixel, signal and the second pixel signal correspond to first and second respective reference voltage signals for first and second respective voltage buffers of the display panel.

6. The display controller of claim 5, wherein the different locations on the display panel correspond to groups of pixels within a pixel array of the display panel.

7. The display controller of claim 5, wherein the memory is further configured to store a correspondence between the pixel compensation values and different types of inversion schemes that can be employed by the display controller.

8. The display controller of claim 5, wherein the memory is further configured to store correspondence between the pixel compensation values and different polarities for the first pixel and the second pixel on the display panel.

9. The display controller of claim 5, wherein the logic component includes:

a position tracker for determining a location of the first pixel and the second pixel based in part on a timing of a pixel clock signal input to the position tracker.

10. A computing device, comprising:

a display panel comprising a pixel array;

a graphics processor configured to generate a pixel signal for each pixel of the pixel array; and a display driver configured to determine a location of each pixel in the pixel array and compensate a VCOM voltage for each pixel according to a distance between the location of the pixel in the pixel array and a voltage source for the pixel to reduce flicker occurring at the display panel, wherein the VCOM voltage compensation is selected based on an inversion scheme having a correspondence provided in one or more lookup tables.

11. The computing device of claim 10, further comprising: a memory configured to store at least one lookup table that includes a correspondence between locations of pixels in the pixel array and a voltage compensation value for each location.

12. The computing device of claim 11, wherein the at least one lookup table includes a plurality of locations in the pixel array, and each location of the plurality of locations corresponds to a group of pixels on the display panel.

13. The computing device of claim 10, wherein the display driver is further configured to compensate the VCOM voltage of the pixel signal according to a polarity of the pixel.

14. The computing device of claim 10, wherein the display driver is further configured to compensate the VCOM voltage of the pixel signal according to a type of inversion scheme executing at the display panel.

15. The computing device of claim 10, wherein the display driver is further configured to compensate the VCOM voltage of the pixel signal according to a type of inversion scheme executing at the display panel.

16. The computing device of claim 10, wherein the pixel includes an organic light emitting diode that is operable in the display panel at different polarities.

17. The method of claim 1, wherein adjusting the VCOM voltage for the pixel comprises providing an adjusted VCOM voltage from a first voltage buffer of a plurality of voltage buffers that are each coupled to at least one pixel of the pixel array, and wherein the method further comprises providing an additional adjusted VCOM voltage from at least a second voltage buffer of the plurality of voltage buffers.

18. The computing device of claim 10, further comprising a plurality of voltage buffers, each coupled to at least one of the pixels in the pixel array via a corresponding voltage buffer line, wherein the display driver is configured to compensate the VCOM voltage for each pixel by providing a plurality of VCOM voltages from the plurality of voltage buffers.

19. The computing device of claim 18, wherein the display driver comprises a column driver disposed on a first side of the pixel array, and wherein the plurality of voltage buffers are disposed on an opposing second side of the pixel array.

* * * * *